US011131125B2

(12) United States Patent
Handke

(10) Patent No.: US 11,131,125 B2
(45) Date of Patent: Sep. 28, 2021

(54) MOTOR VEHICLE DOOR LOCK

(71) Applicant: Kiekert AG, Heiligenhaus (DE)

(72) Inventor: Armin Handke, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 697 days.

(21) Appl. No.: 15/565,204

(22) PCT Filed: Apr. 6, 2016

(86) PCT No.: PCT/DE2016/100161
§ 371 (c)(1),
(2) Date: Oct. 9, 2017

(87) PCT Pub. No.: WO2016/162020
PCT Pub. Date: Oct. 13, 2016

(65) Prior Publication Data

US 2018/0073281 A1 Mar. 15, 2018

(30) Foreign Application Priority Data

Apr. 8, 2015 (DE) ..... 10 2015 004 282.3

(51) Int. Cl.
*E05B 79/04* (2014.01)
*E05B 85/02* (2014.01)

(52) U.S. Cl.
CPC ..... *E05B 79/04* (2013.01); *E05B 85/02* (2013.01); *Y10T 292/1047* (2015.04)

(58) Field of Classification Search
CPC ..... E05B 79/04; E05B 85/02; E05B 9/048; Y10T 292/1047
USPC ..... 292/216
See application file for complete search history.

(56) References Cited

U.S. PATENT DOCUMENTS 4,634,159 A * 1/1987 Uchida ..... B60J 5/0433 292/336.3
4,913,477 A * 4/1990 Watanuki ..... E05B 77/34 292/216
5,186,504 A * 2/1993 Takaishi ..... E05B 85/02 292/216
5,617,676 A * 4/1997 Kleefeldt ..... B60J 5/0416 49/502

(Continued)

FOREIGN PATENT DOCUMENTS

DE 19524232 A1 * 5/1996 ..... B60J 5/0416
DE 10018431 * 10/2001

(Continued)

OTHER PUBLICATIONS

International Search Report and Written Opinion for corresponding Patent Application No. PCT/DE2016/100161 dated Jul. 1, 2016.

*Primary Examiner* — Carlos Lugo
(74) *Attorney, Agent, or Firm* — Renner, Otto, Boisselle & Sklar, LLP

(57) ABSTRACT

The object of the invention is a motor vehicle door lock, comprising a lock case (1) connected to a motor vehicle door (5, 6, 7) and a lock housing (2) connected to the lock case (1). In addition, a fastening element (11) for additional fixing of the lock housing (2) on the motor vehicle door (5, 6, 7), is provided. According to the invention, the fastening element (11) is designed so as to be removable both from the lock case (1) and the lug (11) coupling with the lock housing (2).

14 Claims, 3 Drawing Sheets

(56) References Cited

U.S. PATENT DOCUMENTS

Figure 1:
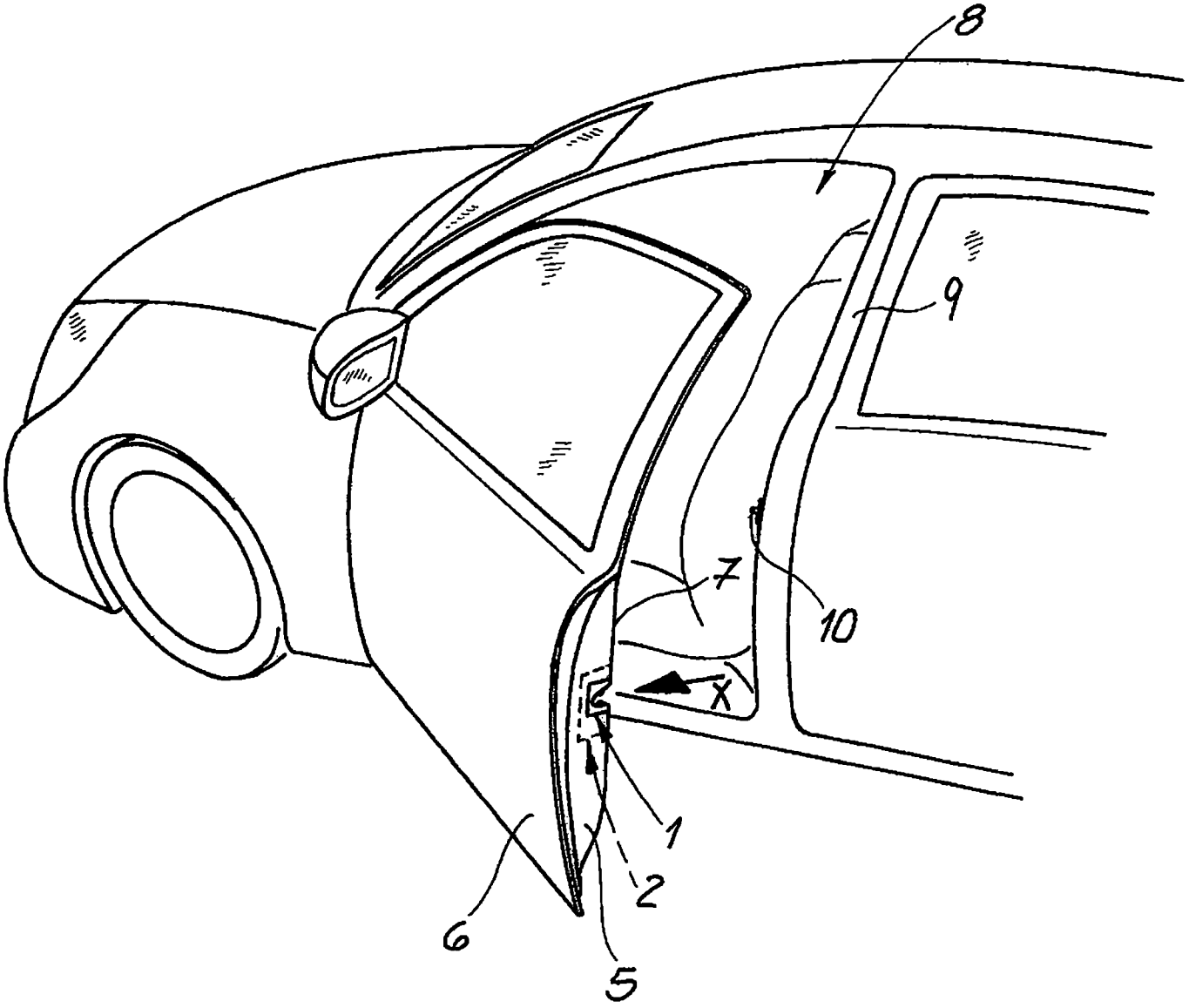

| | | | | | |
|---|---|---|---|---|---|
| 6,059,328 | A * | 5/2000 | Gomi | E05B 77/34 | 292/216 |
| 6,109,674 | A * | 8/2000 | Bartel | E05B 81/06 | 292/201 |
| 6,497,436 | B1 * | 12/2002 | DeBlock | E05B 81/06 | 292/201 |
| 6,698,805 | B2 * | 3/2004 | Erices | E05B 77/04 | 292/201 |
| 8,662,545 | B2 * | 3/2014 | Taga | E05B 85/02 | 292/216 |
| 8,894,153 | B2 * | 11/2014 | Ohba | B60N 2/2352 | 297/378.13 |
| 9,976,323 | B2 * | 5/2018 | Nozawa | E05B 85/243 | |
| 9,982,468 | B2 * | 5/2018 | Mittelbach | E05B 77/04 | |
| 10,603,989 | B2 * | 3/2020 | Keller | E05B 79/04 | |
| 2004/0124664 | A1 * | 7/2004 | McClure | B60J 5/107 | 296/146.8 |
| 2007/0126259 | A1 * | 6/2007 | Almeida | E05B 17/0012 | 296/146.1 |
| 2015/0145262 | A1 * | 5/2015 | Gotzen | E05B 77/10 | 292/194 |
| 2015/0191945 | A1 | 7/2015 | Yamaguchi et al. | | |
| 2016/0290006 | A1 * | 10/2016 | Keller | E05B 79/04 | |

FOREIGN PATENT DOCUMENTS

| | | | | | |
|---|---|---|---|---|---|
| DE | 20111158 | U1 | | 10/2001 | |
| DE | 10256755 | A1 | * | 6/2004 | E05B 79/04 |
| DE | 20317708 | U1 | | 3/2005 | |
| DE | 102006059583 | A1 | * | 6/2008 | E05B 79/04 |
| DE | 20 2010 007352 | U1 | | 10/2011 | |
| DE | 102010063868 | A1 | | 6/2012 | |
| DE | 202012104145 | U1 | * | 2/2014 | E05B 79/04 |
| DE | 102014007525 | A1 | * | 11/2015 | E05B 79/04 |
| DE | 102015105409 | A1 | * | 12/2016 | E05B 79/02 |
| EP | 1039079 | | * | 9/2000 | |
| EP | 1329350 | A2 | * | 7/2003 | B60J 5/0437 |
| EP | 2834436 | B1 | * | 1/2019 | E05B 77/04 |
| FR | 2773580 | A1 | * | 7/1999 | E05B 17/0012 |
| FR | 2787492 | A1 | * | 6/2000 | E05B 79/04 |
| FR | 2852347 | A1 | * | 9/2004 | E05B 85/02 |
| FR | 2 959 767 | A1 | | 11/2011 | |
| FR | 2959767 | A1 | * | 11/2011 | E05B 79/04 |
| FR | 3010122 | A1 | * | 3/2015 | E05B 85/243 |
| GB | 2321920 | A | * | 8/1998 | E05B 79/04 |
| GB | 2405618 | A | * | 3/2005 | B60J 5/0431 |
| GB | 2 489 377 | A | | 9/2012 | |
| WO | WO-2004101924 | A1 | * | 11/2004 | E05B 77/02 |
| WO | 2014/021162 | A1 | | 2/2014 | |

* cited by examiner

MOTOR VEHICLE DOOR LOCK

The invention relates to a motor vehicle door latch, with a latch case connected to a motor vehicle door and a latch housing connected to the latch case and with a fixing element for the additional fixing of the latch housing to the motor vehicle door.

In general, the latch case serves at least to accommodate a locking mechanism consisting primarily of a catch and a pawl. Furthermore, the motor vehicle door latch is connected to the pertaining motor vehicle door with the aid of the latch case. To this end, the latch case is generally made of metal and is mechanically connected to a front surface or front side of the relevant motor vehicle door. This can occur by means of fixing screws which go through the relevant front side and are anchored in thread holes of the latch case.

The front side or front surface of the motor vehicle door generally connects an external door panel with an internal door panel. By means of the affixing of the motor vehicle door latch on the front side or front surface the fixing screws are covered for fixing. This also applies to a locking bolt or latch holder interacting with the locking mechanism of the motor vehicle door latch. While the motor vehicle door latch is connected to the motor vehicle door, the relevant latch holder is generally located on the chassis, for example on a B- or C-pillar.

From the state of the art according to DE 10 2010 063 868 A1, for example, a motor vehicle door latch is known which is equipped with an additional reinforcement insert. The reinforcement insert is a component of the latch case and formed from this in the present case. A safe-operation motor vehicle door latch should thus be provided which can be produced with little manufacturing cost. This has been proven in principle.

In addition, through DE 203 17 708 U1 an assembly carrier with an integrated latch mounting is known for a motor vehicle door. To this end, the assembly carrier is equipped with at least one fixing section for the relevant motor vehicle door latch. The motor vehicle door latch is connected via a latch holding angle with the assembly carrier. Thus, the affixing of the motor vehicle door latch to the assembly carrier or door module carrier which can be inserted into the motor vehicle door should be optimized.

In the class-specific state of the art according to DE 20 2010 007 352 U1, a motor vehicle door latch is described which is equipped with an affixing element for connection of the latch housing to the motor vehicle door. To this end, the affixing element is formed as a molding of the motor vehicle door adjacent on the housing body of the latch housing. Mounting and installation are thus simplified and impact protection simultaneously increased. In fact, the affixing element for additional fixing of the latch housing on the motor vehicle door in essence ensures that crash safety is increased overall.

Because in the case of an impact the predominant requirement is that the relevant motor vehicle door can be opened easily and in an unchanged manner. Only thus can the occupants inside who may be injured be easily rescued. A pre-requisite for this is the far-reaching freedom from damage of the crucial mechanical latch components inside the latch case and the latch housing.

The known measures for additional fixing of the latch housing to the motor vehicle door have been proven according to the teaching of DE 20 2010 007 352 U1. However, the execution of the known affixing element inter alia requires a molding which needs to be provided on the motor vehicle door as a notch or a deep-drawing molding. This encounters acceptance problems with automotive manufacturers. Such measures are also costly. —This also applies to a procedure known from practice in which the affixing element is formed so to speak as an extension of the latch case for holding of the latch housing. This is where the invention is starts from.

The invention is based on the technical problem of further developing such a motor vehicle door latch in such a way that the manufacture and mounting take place with the least possible expense and material use is reduced.

In order to solve this technical problem, a class-specific motor vehicle door latch within the scope of the invention is characterized by the affixing element being formed as a detachably connected bracket with the latch case and the latch housing.

Within the scope of the invention, neither a recess nor a notch is used in the motor vehicle door as described by the registered design DE 20 2010 007 352 U1 forming the starting point in an embodiment. Any engagements on the motor vehicle door thus cease to apply and acceptance problems with automotive manufacturers are consequently not to be feared. An affixing element connected to the latch case is also executed as implemented by the practice variant. Material use is thus reduced overall because the affixing element is no (longer) an integral component of the latch case according to the invention. Any "waste" in the manufacture of this integral component does not therefore occur from the outset.

Instead, the affixing element is a separate bracket which is detachably connected to both the latch case and the latch housing and can naturally also be disconnected due to the detachability. Additional mounting advantages thus result. Furthermore, the material use for the bracket can be considerably reduced compared to an affixing element which is integral with the latch case.

Because the latch case on the one hand and the bracket on the other hand are produced separately from one another and can be optimized accordingly with regard to any "wastage". In fact, in both cases stamping/bending processes are used. The latch case and the affixing element or the bracket are therefore stamping/bending components respectively.

Nevertheless, comparable strengths are observed and ensured as for the state of the art, that both the latch case and the latch housing are of a structurally stable design overall, even in the case of an impact. The latch case and the bracket too are respectively made of high-strength steel for this purpose.

Finally, the solution according to the invention is characterized by especially simple mounting. Because the latch housing and the affixing element or the bracket can be connected together with the latch case to form the completed motor vehicle door latch. The detachable connection of the bracket both with the latch case and the latch housing also enable slight offsetting of play. These are the fundamental advantages.

According to a preferred embodiment, the bracket straddles an area close to the front surface in its lengthwise direction of the latch case fixed to the motor vehicle door to the edge of the latch housing. i.e. the bracket is detachably connected to the latch case with its one end, namely on the area of the latch case fixed to the motor vehicle door close to the front surface. This area close to the front surface identifies an area of the latch case which is arranged close to the relevant front surface of the motor vehicle door. This usually involves a so-called locking mechanism leg of the latch case which is connected to the relevant front surface by means of the aforementioned fixing screws.

In its lengthwise extension the bracket reaches to the edge of the latch housing from this area of the latch case close to the front surface. The latch housing is straddled over practically its entire width or height with the aid of the bracket so that the bracket simultaneously thus stiffens the latch housing. Because the bracket is usually connected to both the motor vehicle door and the latch housing.

Due to this stiffening of the latch housing with the aid of the bracket the structural stability of the motor vehicle door latch is guaranteed, even in the case of impact. This applies in particular to a frontal impact, but also in the case of a lateral impact. In any case, the bracket ensures that crucial latch components typically accommodated in the latch housing, such as an external activation lever, do not change or only slightly change their position compared to the locking mechanism accommodated in the latch case so that the relevant motor vehicle door latch itself can be mechanically opened after such an impact in order to free the occupants. The function of the locking mechanism fundamentally comprising a catch and a pawl is still guaranteed anyway because the locking mechanism is accommodated in the robust latch case.

For reasons of simple and cost-effective manufacture, the bracket is generally rectangular. Furthermore, the bracket is advantageously inserted into the latch case with its end on the latch case side. For this purpose, the bracket may have a pin at the relevant latch case side end. The relevant pin engages into a relevant pin mounting on the latch case for the detachable connection of the bracket with the latch case. This pin mounting can be molded into the latch case or executed as an additional pin mounting on the latch case.

At its end on the latch housing side, on the contrary the bracket reaches behind with the relevant end of a housing web, i.e. a web provided for in or on the latch housing. In general, the web together with a further web at a distance from the former may overall define a pouch for engagement of the latch housing side end of the bracket. For this purpose, the bracket typically has a chamfer on the relevant end of the latch housing side. The chamfer reaches behind the housing web in the detachable connection of the latch housing side of the bracket with the latch housing.

Both the pin on the latch housing side end and also the chamfer on the latch housing side end of the bracket can be produced overall—like the bracket itself—in a single working step or working process. In fact, the bracket is a stamping/bending component which may be produced from the already previously stated high-strength steel.

The same steel or material is typically also used to execute the latch case. Even in the case of the latch case, this is a stamping/bending component which is easy and cost-effective to produce. Because the latch case is usually L-shaped.

In fact, the L-shaped latch case generally comprises a locking mechanism leg and a lateral leg. The locking mechanism leg accommodates the locking mechanism. Furthermore, the locking mechanism leg ensures anchoring of the latch case on the front surface of the motor vehicle door. In contrast, the lateral leg is mainly attributed a stabilizing function. Furthermore, the configuration is usually such that the bracket extends in the extension of the lateral leg and predominantly vertically compared to the locking mechanism leg. Thus, the relevant lateral leg and also the bracket run mainly parallel to the internal door panel. In contrast, the locking mechanism leg of the L-shaped latch case is connected to the largely vertical front surface or front side of the motor vehicle door in contrast.

As already explained, the bracket is connected to both the motor vehicle door and the latch housing. In fact, the bracket is connected to the motor vehicle door on its latch housing side end. In contrast, a central piece of the bracket is connected to the latch housing.

The central piece of the bracket is located between the latch case side end and the latch housing side end of the bracket.

While the connection of the bracket to the motor vehicle door is aided or can be aided by at least a fixing screw which engages into a thread in the bracket, the bracket is connected to the latch housing typically in such a way that connecting pins are provided for this purpose. Naturally, any other connecting elements can be used here. The only crucial factor is that the bracket practically follows the width or height expansion of the latch housing because it extends in the extension of the lateral leg and mainly vertical to the locking mechanism leg. Furthermore, the bracket is detachably connected both to the latch case and the latch housing. Furthermore, the bracket experiences additional anchoring on the motor vehicle door with its latch housing side end.

Thus, the latch housing which is typically made of plastic and is present as a plastic injection molded component is also stiffened as requested. This applies in particular with regard to the crucial latch components accommodated in the latch housing such as the external activation lever on whose unchanged function it depends whether the relevant motor vehicle door latch can still be opened even after an accident. These are the fundamental advantages.

Figure 2:
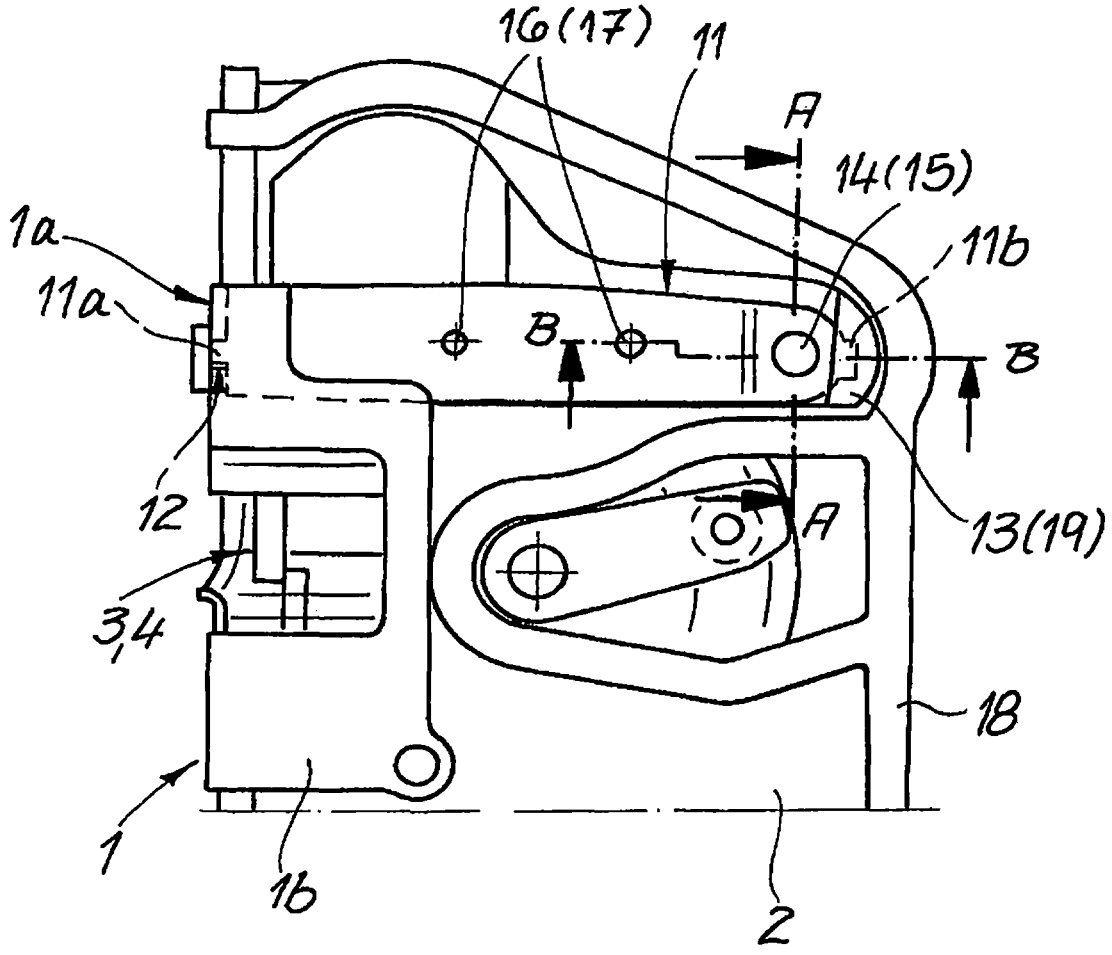
Figure 3:
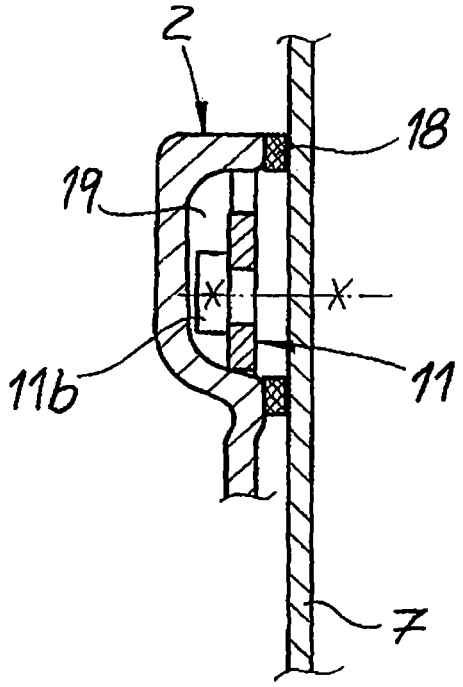
Figure 4:
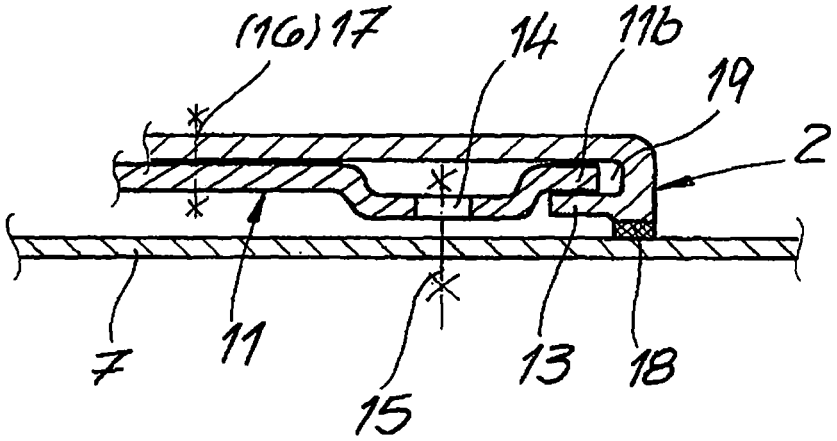

The invention is explained in further detail hereafter on the basis of a drawing which only constitutes an exemplary embodiment. The following are shown:

FIG. 1 a motor vehicle door which is equipped with the motor vehicle door latch according to the invention, FIG. 2 a view on the object according to FIG. 1 from direction X, FIG. 3 a cut through FIG. 2 along line A-A and FIG. 4 a cut through FIG. 2 along line B-B.

In the figures, a motor vehicle door latch is illustrated which in its fundamental construction according to FIG. 1 comprises a latch case 1 and an associated latch housing 2. While the latch case 1 is made of metal and in particular a high-strength steel, the latch housing 2 is usually a molded plastic component which can be manufactured, for example, by plastic injection molding.

The latch case 1 is L-shaped according to FIGS. 1 and 2. In fact, the latch case 1 comprises a locking mechanism leg 1*a* and a lateral leg 1*b*. The locking mechanism leg 1*a* accommodates a locking mechanism 3, 4 depicted in FIG. 2 which fundamentally comprises a catch 3 and an interacting pawl 4.

The latch case 1 or its locking mechanism leg 1*a* for accommodation of the locking mechanism 3, 4 is connected to a front surface 5 of a motor vehicle door 5, 6, 7 or anchored with this front surface 5. In fact, the relevant motor vehicle door 5, 6, 7 according to FIG. 1 comprises an external panel 6 and an internal panel 7 at a distance. The external panel 6 and the internal panel 7 are separated from one another by the front surface or front side 5 which are respectively largely vertical in comparison. In the closed state of the motor vehicle door 5, 6, 7 the front surface or front side 5 is consequently not visible in a recess 8 of a motor vehicle chassis illustrated in FIG. 1. The recess 8 is a door opening 8.

On the edge of the door opening 8 on a B-pillar 9 there, a solely illustrated latch holder 10 is anchored with the motor vehicle chassis. The latch holder 10 interacts with the aid of its locking bolt with the locking mechanism 3, 4 of the motor vehicle door latch in order to maintain the motor vehicle door 5, 6, 7 in the closed state.

On the basis of the view from direction X of the motor vehicle door latch according to FIG. 2, it is apparent that in addition to the two fundamental structural elements of the motor vehicle door latch, namely the latch case 1 and the latch housing 2 connected to the latch case 1, initially a fixing element 11 is provided for and executed. With the aid of this fixing element 11 the latch housing 2 is complementarily fixed on the motor vehicle door 5, 6, 7. According to the invention, the fixing element 11 is a bracket 11 which is configured and executed independently of the latch case 1 and the latch housing 2.

In fact, the bracket 11 is detachably connected or connectable both to the latch case 1 and also to the latch housing 2. The relevant bracket 11 straddles an area close to the front surface in its lengthwise extension illustrated in FIG. 2 of the latch case 1 fixed on the motor vehicle door 5, 6, 7 to the latch housing 2. For this purpose, the bracket 11 possesses a pin 11*a* at its latch case side end and is inserted into the latch case 1, in the exemplary embodiment the locking mechanism leg 1*a* with this pin 11*a*. For this purpose, the latch case 1 may have a relevant pin mounting 12 illustrated in FIG. 2. The pin mounting 12 can be formed in or on the latch case 1, more accurately in or on the locking mechanism leg 1*a*. However, it is also possible to work with a pin mounting 12 connected to the latch case 1.

In contrast, the bracket 11 is equipped with a chamfer 11 on the latch housing side end. On the basis of FIG. 4, it is apparent that the chamfer 11 reaches behind a housing web 13 as part of the housing 2. Furthermore, the latch housing side end or the chamfer 11*b* of the bracket 11 may engage into a pouch 19 in the housing 2 which is illustrated in FIG. 4, but does not absolutely need to be executed.

The bracket 11 configured as a rectangle in the exemplary embodiment consequently extends from the area of the latch case 1 fixed to the motor vehicle door 5, 6, 7 close to the front surface 1 and the pin there 11*a* to its latch housing side end with the chamfer 11*b*. i.e. the bracket 11 mainly straddles the latch housing 2 with regard to its entire width or height, as illustrated in FIG. 2. The latch housing 2 is thus stiffened with the aid of the bracket 11, especially in the case of an accident.

For this purpose, the bracket 11 is additionally connected to its latch housing side end on the motor vehicle door 5, 6, 7. In fact, at the latch housing side end of the bracket 11 a boring 14 is apparent in which a screw 15 illustrated in FIG. 4 may engage which simultaneously reaches through a pertaining opening in the internal door panel 7. In addition, in the central piece of the bracket 11 between the pin 11*a* and the chamfer 11*b* two openings 16 are apparent which are reached through by pins 17 illustrated in FIG. 4. The bracket 11 is connected to the latch housing 2 with the aid of the pins 17. The latch housing 2 thus experiences optimum reinforcement with the aid of the bracket 11. A circumferential seal 18 on the surface of the latch housing 2 turned towards the internal door panel 7 ensures that the latch housing 2 is sealed compared to the relevant internal door panel 7.

To mount the illustrated motor vehicle door latch the bracket 11 is initially detachably inserted into the latch case 1*a* or the pin mounting 12 with the pin 11*a*. The latch housing 2 is then connected to the latch case 1. At the same time, the nose or chamfer 11*b* of the bracket 11 reaches behind the fixing web 13 of the latch housing 2. Hereby, the relevant chamfer 11*b* may simultaneously engage into the pouch 19 illustrated in FIGS. 3 and 4 in the latch housing 2. Finally, the bracket 11 is generally firmly connected to the latch housing 2 with the aid of the pins 17.

To fix the completed motor vehicle door latch on the motor vehicle door 5, 6, 7 the latch case 1 is initially screwed on the front side or front surface 5. Finally, the fixing leg 11 is connected to the internal door panel 7 in which the screw 15 engages into the relevant opening 14 in the bracket 11. In this process, the circumferential seal 18 on the latch housing 2 ensures that the intermediate space apparent in particular between the latch housing 2 and the relevant internal door panel 7 is sealed externally in FIGS. 3 and 4.

It is apparent that the bracket 11 extends in an extension of the lateral leg 1*b* of the latch case 1. Furthermore, the bracket 11 mainly runs vertically to the locking mechanism leg 1*a*. The bracket 11 thus follows the greatest expansion of the latch housing 2 and can optimally stiffen this.

The invention claimed is:

1. A motor vehicle door latch comprising:

a latch case connected to a motor vehicle door and configured to accommodate a locking mechanism;

a latch housing connected to the latch case; and a fixing element for additional fixing of the latch housing to the motor vehicle door, wherein the fixing element is detachably formed as a connectable bracket with the latch case and also the latch housing, wherein the bracket has a lengthwise extension that extends from a first end of the bracket at which the bracket is detachably connected to the latch case separately from the latch housing, along the latch housing, to an edge of the latch housing at which an opposite end of the bracket is detachably connected to the latch housing separately from the latch case, and wherein the first end of the bracket is attached to a side wall of the latch case on which the locking mechanism is mounted and which is attached to the motor vehicle door, the bracket extending perpendicular to the side wall of the latch case, wherein the bracket is configured to receive a fastener that secures the bracket to an internal door panel of the motor vehicle door, therefore, securing the latch housing to the internal door panel of the motor vehicle door, and wherein a sealing element is positioned between the latch housing and the internal door panel of the motor vehicle door to ensure that a space between them is sealed externally.

2. The motor vehicle door latch according to claim 1, wherein the latch housing includes a housing base and a web, both defining a pocket configured to receive the opposite end of the bracket, so that the housing base and web straddle the bracket.

3. The motor vehicle door latch according to claim 1, wherein the bracket is configured as a rectangle.

4. The motor vehicle door latch according to claim 1, wherein the bracket is inserted into the latch case with its latch case side end.

5. The motor vehicle door latch according to claim 4, wherein the bracket on the latch case side end has a pin which engages into a pin mounting on the latch case.

6. The motor vehicle door latch according to claim 2, wherein the bracket reaches behind the housing web with a latch housing side end.

7. The motor vehicle door latch according to claim 2, wherein the bracket on the latch housing side end has a chamfer which reaches behind the housing web.

8. The motor vehicle door latch according to claim 1, wherein the bracket is connected to the motor vehicle door on a latch housing side end.

9. The motor vehicle door latch according to claim 1, wherein the bracket is connected to the latch housing at a central piece of the bracket in addition to the opposite end of the bracket.

10. The motor vehicle door latch according to claim 1, wherein the latch case is L-shaped with the side wall of the latch case being a locking mechanism leg for anchoring to a front surface of the motor vehicle door, the latch case further including a lateral leg.

11. The motor vehicle door latch according to claim 1, wherein the first end of the bracket is arranged in an area close to a front surface of the motor vehicle door.

12. The motor vehicle door latch according to claim 2, wherein the end of the bracket is defined by a chamfer that is received in the pocket between the housing base and the web.

13. The motor vehicle door latch according to claim 1, wherein the opposite end of the bracket that is detachably connected to the latch housing is attached to the motor vehicle door.

14. A motor vehicle door latch comprising:

a latch case connected to a motor vehicle door and configured to accommodate a locking mechanism;

a latch housing connected to the latch case; and a fixing element for additional fixing of the latch housing to the motor vehicle door, wherein the fixing element is detachably formed as a connectable bracket with the latch case and also the latch housing separably from the latch case, wherein the connectable bracket is detachably connected to each of the latch case and the latch housing, wherein the bracket has a lengthwise extension that extends from a first end of the bracket at which the bracket is detachably connected to the latch case separately from the latch housing, along the latch housing, to an edge of the latch housing at which an opposite end of the bracket is detachably connected to the latch housing separately from the latch case, and wherein the latch housing includes a housing base and a web, both defining a pocket configured to receive an end of the bracket, so that the housing base and web straddle the bracket, wherein the bracket is configured to receive a fastener that secures the bracket to an internal door panel of the motor vehicle door, therefore, securing the latch housing to the internal door panel of the motor vehicle door, and wherein a sealing element is positioned between the latch housing and the internal door panel of the motor vehicle door to ensure that a space between them is sealed externally.

* * * * *